US008027433B2

(12) United States Patent
Zou et al.

(10) Patent No.: US 8,027,433 B2
(45) Date of Patent: Sep. 27, 2011

(54) METHOD OF FAST CURRENT MODULATION IN AN X-RAY TUBE AND APPARATUS FOR IMPLEMENTING SAME

(75) Inventors: Yun Zou, Clifton Park, NY (US); Carey Shawn Rogers, Brookfield, WI (US); Sergio Lemaitre, Whitefish Bay, WI (US); Mark Alan Frontera, Ballston Lake, NY (US); Edward Emaci, Brookfield, WI (US); Vance Robinson, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 120 days.

(21) Appl. No.: 12/511,815

(22) Filed: Jul. 29, 2009

(65) Prior Publication Data

US 2011/0026681 A1 Feb. 3, 2011

(51) Int. Cl.

| | |
|---|---|
| ***H01J 35/14*** | (2006.01) |
| ***H01J 29/46*** | (2006.01) |
| ***G21K 1/087*** | (2006.01) |

(52) U.S. Cl. ..... 378/138; 378/145; 313/447

(58) Field of Classification Search ..... 378/91, 378/119, 121, 138, 145, 210; 250/370.01, 250/370.08, 370.09, 371, 396, 522.1; 313/441, 313/446, 447, 456–458; 363/112, 116, 121, 363/122; 315/307, 5.37

See application file for complete search history.

(56) References Cited

U.S. PATENT DOCUMENTS

| | | | | |
|---|---|---|---|---|
| 2,296,885 | A | 9/1942 | Vance | |
| 2,365,855 | A * | 12/1944 | Atlee | 378/105 |
| 2,686,884 | A * | 8/1954 | Atlee | 378/136 |
| 2,862,107 | A * | 11/1958 | Cummings | 378/107 |
| 3,363,131 | A * | 1/1968 | Perry | 378/138 |
| 3,433,955 | A * | 3/1969 | Perry | 378/138 |
| 3,596,126 | A * | 7/1971 | Yoshida et al. | 313/412 |
| 5,485,494 | A | 1/1996 | Williams et al. | |
| 5,617,464 | A | 4/1997 | Mika et al. | |
| 5,625,662 | A | 4/1997 | Toth et al. | |
| 5,930,331 | A | 7/1999 | Rentzepis et al. | |

(Continued)

FOREIGN PATENT DOCUMENTS

| | | |
|---|---|---|
| FR | 1381526 | 10/1963 |

(Continued)

OTHER PUBLICATIONS

European Search Report dated Nov. 19, 2010. EP10169348 Search Report, Apr. 14, 2011.

*Primary Examiner* — Anastasia Midkiff
(74) *Attorney, Agent, or Firm* — Scott J. Asmus

(57) ABSTRACT

An x-ray imaging system includes a detector positioned to receive x-rays, and an x-ray tube coupled to a mount structure. The x-ray tube is configured to generate x-rays toward the detector and includes a target, a cathode cup, an emitter attached to the cathode cup and configured to emit a beam of electrons toward the target, the emitter having a length and a width, and a one-dimensional grid positioned between the emitter and the target and attached to the cathode cup at one or more attachment points. The one-dimensional grid includes a plurality of rungs that each extend in a direction of the width of the emitter, and the plurality of rungs are configured to expand and contract relative to the one or more attachment points without substantial distortion with respect to the emitter.

9 Claims, 11 Drawing Sheets

U.S. PATENT DOCUMENTS

| | | | |
|---|---|---|---|
| 6,215,850 | B1 | 4/2001 | Blake et al. |
| 6,385,280 | B1 | 5/2002 | Bittl et al. |
| 6,816,573 | B2 | 11/2004 | Hirano et al. |
| 7,079,623 | B2 | 7/2006 | Heuft et al. |
| 7,085,351 | B2 | 8/2006 | Lu et al. |
| 7,110,500 | B2 | 9/2006 | Leek |
| 7,151,818 | B1 | 12/2006 | Hanington et al. |
| 7,203,268 | B2 | 4/2007 | Yahata |
| 2006/0115050 | A1 | 6/2006 | Resnick |
| 2007/0053495 | A1 * | 3/2007 | Morton et al. ..... 378/136 |
| 2009/0003529 | A1 * | 1/2009 | Zou et al. ..... 378/122 |

FOREIGN PATENT DOCUMENTS

| | | |
|---|---|---|
| GB | 492983 | 9/1938 |
| GB | 625056 | 6/1949 |
| GB | 795146 | 5/1958 |

* cited by examiner

METHOD OF FAST CURRENT MODULATION IN AN X-RAY TUBE AND APPARATUS FOR IMPLEMENTING SAME

BACKGROUND OF THE INVENTION

Embodiments of the invention relate generally to x-ray imaging devices and, more particularly, to an x-ray tube having an improved cathode structure and improved control of electron beam emission.

X-ray systems typically include an x-ray tube, a detector, and a support structure for the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The data acquisition system then reads the signals received in the detector, and the system then translates the radiation variances into an image, which may be used to evaluate the internal structure of the object. One skilled in the art will recognize that the object may include, but is not limited to, a patient in a medical imaging procedure and an inanimate object as in, for instance, a package in an x-ray scanner or computed tomography (CT) package scanner.

X-ray tubes typically include an anode structure for the purpose of distributing the heat generated at a focal spot. An x-ray tube cathode provides an electron beam from an emitter that is accelerated using a high voltage applied across a cathode-to-anode vacuum gap to produce x-rays upon impact with the anode. The area where the electron beam impacts the anode is often referred to as the focal spot. Typically, the cathode includes one or more filaments positioned within a cup for emitting electrons as a beam to create a high-power large focal spot or a high-resolution small focal spot, as examples. Imaging applications may be designed that include selecting either a small or a large focal spot having a particular shape, depending on the application.

It is desirable to deliver sub-microsecond mA modulation of the electron beam and/or gridding in some imaging applications. Some technologies are capable of increasing or decreasing electron beam amperage, but such technologies achieve mA modulation by changing the emitter temperature and thus the emitted beam current. Such mA modulation processes are often slow due to the thermal time constant of the emitter. That is, due to thermal mass of the filament, microsecond waveforms are difficult to obtain with this approach.

To achieve a fast mA response time, gridding technologies are often used to control electron beam operation electrostatically and modulate the mA, either via an intercepting or a non-intercepting grid. These gridding technologies may degrade the focal spot shape during mA modulation due to the presence of a gridding voltage. Such degradation is exacerbated when tube kV is modulated as well (as in, for instance, fast kV switching applications). Typically, if kV is increased or decreased, the mA will correspondingly increase or decrease as a consequence of respectively higher or lower electric fields at the emitter surface. These changes in kV and mA tend to impact the size and location properties of the focal spot during the changing operation.

In one example, a two-dimensional mesh grid is positioned between the cathode and the anode to modulate mA. Rungs of the mesh in the width direction tend to compress the beam more in its width, and corresponding rungs in the length direction tend to compress the beam more in its length. However, a two-dimensional grid tends to cause scatter in both length and width directions, and the amount of scatter is a function of an area of the rungs of the grid. Further, in many applications it is desirable to compress the beam width more than the beam length. Thus, in order to minimize scatter while enabling beam compression in the width dimension, a 1D mesh having rungs in the beam width direction may be implemented. Scatter may be reduced for a 1D grid by minimizing the individual width of the rungs in the 1D mesh and by increasing the length of each rung to ensure that any mount structure to which the rungs are attached are well clear of beam interference.

Because such grids are positioned in the electron beam, they are prone to heating due to deposition of electrons therein. The amount of heating may be reduced by reducing the voltage differential even to a slightly negative value therewith. Further, the amount of interference may be reduced by reducing the rung widths and increasing their lengths as stated above. Thus, not only may scatter be reduced by minimizing interference caused by the rungs, but the amount of heat deposited therein may correspondingly be reduced as well. Nevertheless, electrons are deposited therein during operation, and the electrons thus deposited cause the rungs to heat. Because the grid is positioned in a high vacuum, cooling of the rungs is limited to radiation and conduction modes of heat transfer. Radiant cooling tends to have an excessive time lag compared to the quick response of fast mA modulation. Conduction, likewise, is limited because the rate of conduction is a direct function of cross-sectional area of the rungs and inversely proportional to the length of the rungs. Thus, rungs in a 1D mesh are prone to excessive temperatures during operation, and the effect is aggravated as the rung width or thickness is minimized and as the rung length is increased as discussed above.

Heating and cooling of the rungs causes non-uniform thermal distortions to occur therein, which manifests itself in image quality artifacts and other image-related issues. As the rungs are narrowed in their width to reduce scatter and decrease deposited energy therein, they are, in comparison, made more flimsy and structurally weak. Accordingly, heating during mA modulation tends to non-uniformly distort the rungs, and the amount of distortion is driven by a number of factors that are exacerbated by thinning them. Distortion may manifest as, for example, bending and twisting of the rungs with respect to one another, the emitter, or the cup in which the emitter is mounted.

Therefore, it would be desirable to have an apparatus and method capable of microsecond mA modulation of an electron beam while maintaining image quality in an x-ray imaging device.

BRIEF DESCRIPTION

Embodiments of the invention provides an apparatus and method that overcome the aforementioned drawbacks by providing for modulating amperage of an electron beam and rapid control of focal spot size and location associated with an x-ray imaging device.

In accordance with one aspect of the invention, an x-ray imaging system includes a detector positioned to receive x-rays, and an x-ray tube coupled to a mount structure. The x-ray tube is configured to generate x-rays toward the detector and includes a target, a cathode cup, an emitter attached to the cathode cup and configured to emit a beam of electrons toward the target, the emitter having a length and a width, and a one-dimensional grid positioned between the emitter and the target and attached to the cathode cup at one or more attachment points. The one-dimensional grid includes a plurality of rungs that each extend in a direction of the width of the emitter, and the plurality of rungs are configured to expand and contract relative to the one or more attachment points without substantial distortion with respect to the emitter.

In accordance with another aspect of the invention, a method of fabricating a cathode assembly includes attaching a filament to a cathode cup, forming a one-dimensional grid having crosspieces that extend generally along a width direction of the filament, positioning the grid proximately to the filament such that electrons that emit from the filament pass between the crosspieces of the one-dimensional grid when accelerated toward an anode, and attaching the grid to the cathode cup at attachment points such that the crosspieces expand, when heated, relative to the attachment points without distorting with respect to neighboring crosspieces.

In accordance with yet another aspect of the invention, an x-ray tube includes a target configured to emit electrons from a focal spot, a cup, an emitter attached to the cup and positioned to emit high-energy electrons toward the focal spot, and a uni-dimensional grated mesh positioned proximately to the emitter and between the target and the emitter such that emitted electrons pass between rungs of the mesh. The uni-dimensional grated mesh is attached to the cup at attachment points such that rungs of the mesh expand and contract, upon heating and cooling, without substantial distortion with respect to the cup.

Various other features and advantages will be made apparent from the following detailed description and the drawings.

BRIEF DESCRIPTION OF THE DRAWINGS

The drawings illustrate one or more embodiments presently contemplated for carrying out embodiments of the invention.

In the drawings:

FIGS. 4 and 5 illustrate a cathode having rungs of a one-dimensional mesh slideably attached thereto according to an embodiment of the invention.

DETAILED DESCRIPTION

Figure 1:
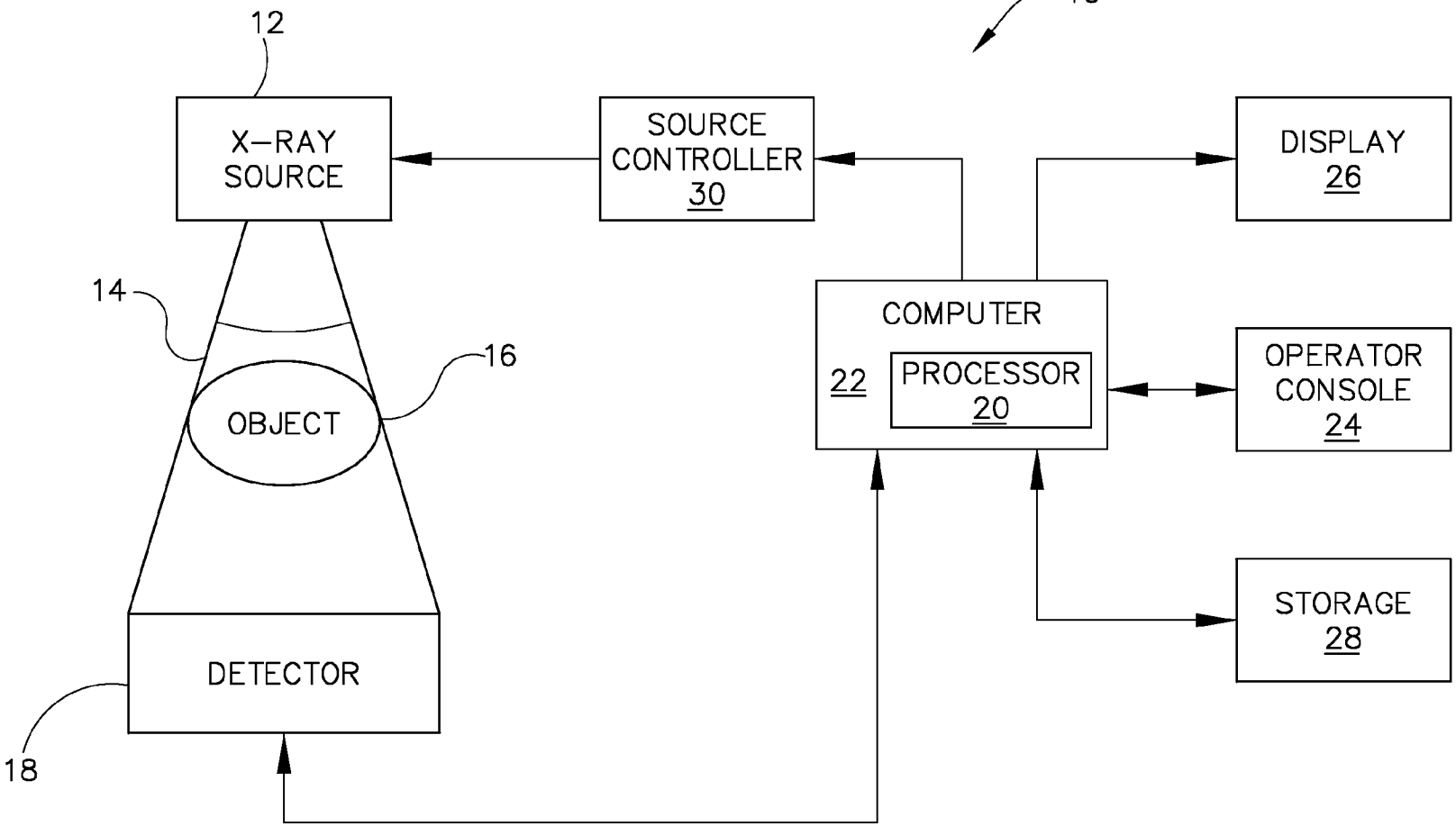
FIG. 1 is a block diagram of an imaging system that can benefit from incorporation of an embodiment of the invention.

FIG. 1 is a block diagram of an embodiment of an imaging system 10 designed both to acquire original image data and to process the image data for display and/or analysis in accordance with embodiments of the invention. It will be appreciated by those skilled in the art that embodiments of the invention are applicable to numerous medical imaging systems implementing an x-ray tube, such as x-ray or mammography systems. Other imaging systems such as computed tomography (CT) systems and digital radiography (RAD) systems, which acquire image three dimensional data for a volume, also benefit from embodiments of the invention. The following discussion of x-ray system 10 is merely an example of one such implementation and is not intended to be limiting in terms of modality.

As shown in FIG. 1, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays 14 pass through object 16 and, after being attenuated by the object, impinge upon a detector 18. Each detector in detector 18 produces an analog electrical signal that represents the intensity of an impinging x-ray beam, and hence the attenuated beam, as it passes through the object 16. In one embodiment, detector 18 is a scintillation based detector, however, it is also envisioned that direct-conversion type detectors (e.g., CZT detectors, etc.) may also be implemented.

A processor 20 receives the signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, flash memory, compact discs, etc. The operator may also use console 24 to provide commands and instructions to computer 22 for controlling a source controller 30 that provides power and timing signals to x-ray source 12.

Figure 2:
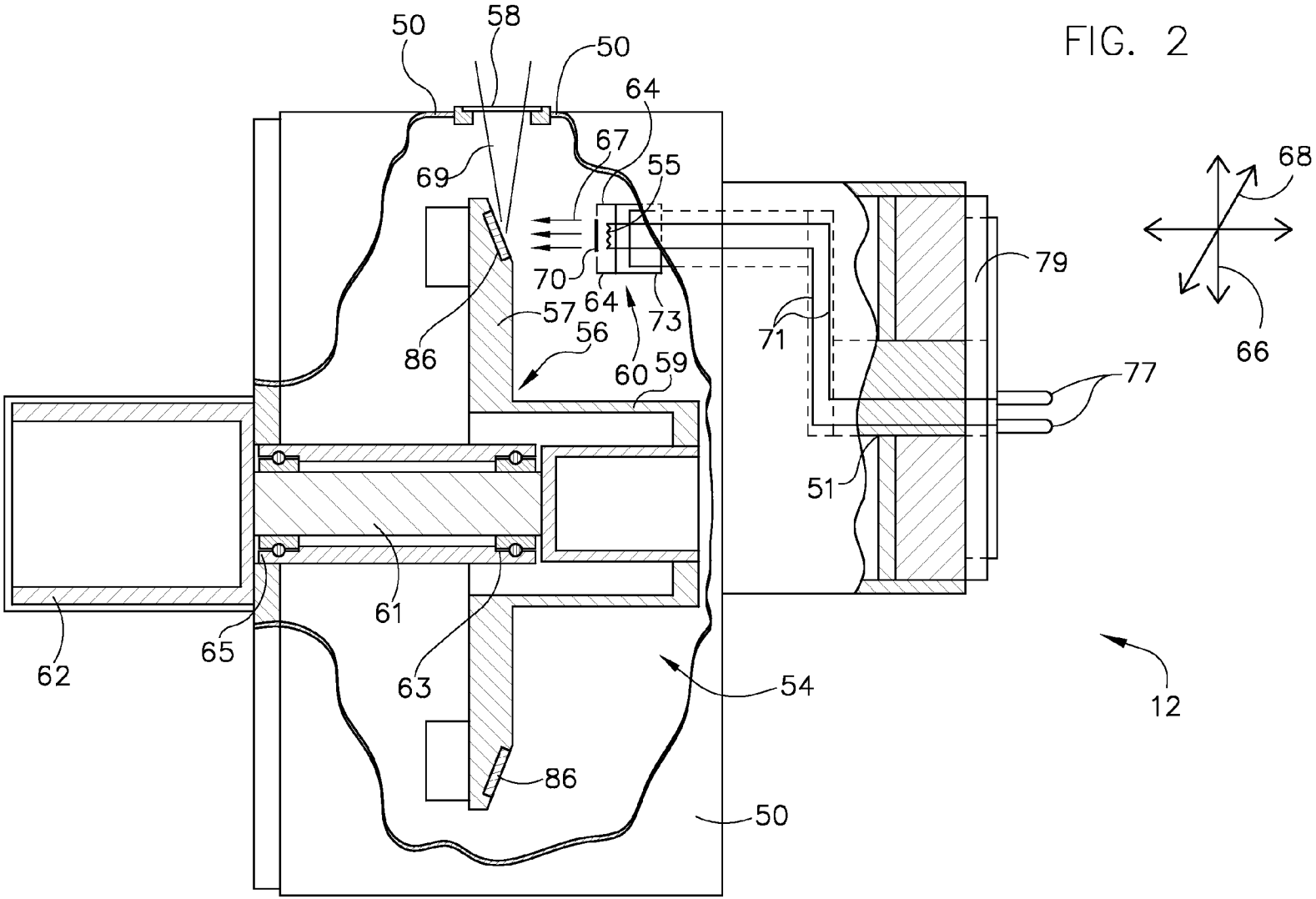
FIG. 2 is a cross-sectional view of an x-ray tube that incorporates embodiments of the invention.

FIG. 2 illustrates a cross-sectional view of an x-ray tube 12 incorporating embodiments of the invention. X-ray tube 12 includes a frame 50 that encloses a vacuum region 54, and an anode 56 and a cathode 60 are positioned therein. Anode 56 includes a target 57 having a target track 86, and a target hub 59 attached thereto. Terms "anode" and "target" are to be distinguished from one another, where target typically includes a location, such as a focal spot, wherein electrons impact a refractory metal with high energy in order to generate x-rays, and the term anode typically refers to an aspect of an electrical circuit which may cause acceleration of electrons theretoward. Target 56 is attached to a shaft 61 supported by a front bearing 63 and a rear bearing 65. Shaft 61 is attached to a rotor 62. Cathode 60 typically includes a cathode cup 73 and an emitter or filament 55 coupled to a plurality of electrical leads 71 that pass through a center post 51. Feedthrus 77 pass through an insulator 79 and are electrically connected to electrical leads 71. In embodiments of the invention, cathode 60 includes a uni-or one-dimensional grated mesh or grid 70 (the one-dimensional grid will be discussed and further defined with respect to FIG. 3) positioned proximate emitter 55 and positioned between emitter 55 and target track 86. X-ray tube 12 includes a window 58 typically made of a low atomic number metal, such as beryllium, to allow passage of x-rays therethrough with minimum attenuation.

In operation, target 56 is spun via a stator (not shown) external to rotor 62. An electric current is applied to emitter 55 via feedthrus 77 to heat emitter 55 and emit electrons 67 therefrom. A high-voltage electric potential is applied between anode 56 and cathode 60, and the difference therebetween accelerates the emitted electrons 67 from cathode 60 to anode 56. The electrons 67 impinge the target 57 at the target track 86 and x-rays 69 emit therefrom and pass through the window 78. A voltage is applied to grid 70 to control emission of beam 69 and to modulate beam 69 according to embodiments of the invention.

Cathode 60 and one-dimensional grid 70 may be fabricated according to embodiments of the invention. As will be described, FIGS. 4-12 illustrate embodiments of one-dimensional grid 70 and emitter 55 of cathode 60. In all embodiments described herein, emitter 55 is illustrated as a flat filament from which electrons are accelerated toward target 57, and more particularly toward target track 86. However, it is to be understood that emitter 55 may be any configuration of a filament, to include a D-shaped coiled filament, a cylindrically or helically wound coil filament, a rectangular coil filament, a filament or emitter having a curved or flat profile, and the like. In the embodiment that includes an emitter having a curved profile, according to one embodiment, the curvature is along a width of the emitter and includes a concave surface that is positioned to emit electrons therefrom. In an embodiment that includes a concave surface, the emitter is a concave emitter having approximately a 1 mm depth of curvature for an emitter having approximately a 3 mm width.

Emitter 55 of cathode 60 may include a dispenser cathode (such as an oxide of calcium, barium, and aluminum embedded in a tungsten matrix such that the oxide formed on the surface decreases work function and operating temperature, thus increasing emission efficiency when compared to tungsten), an LaB6 cathode (typically a bulk single crystal or deposited polycrystalline layer of LaB6 having a decreased work function and decreased operating temperature, hence an increased efficiency when compared to tungsten), and the like. Cathode 60 may thus include any emitter that is configured to emit electrons toward an anode, and cathode 60 includes a number of embodiments for one-dimensional grid 70 according to embodiments of the invention.

According to embodiments of the invention and as understood in the art, cathode 60 may include length electrodes 64 or width electrodes (not shown) that may be positioned proximately to emitter 55. The electrodes may include a pair of width electrodes, a pair of length electrodes, or both. As understood in the art, each electrode of the pair of electrodes may have an independent voltage for beam focusing and/or deflection applied thereto. For instance, as understood in the art, when applying a differential voltage on the width or length electrodes, the beam of electrons emitting from emitter 55 (such as electrons 67 illustrated in FIG. 2) can be wobbled. As another example, each pair of electrodes may have a single voltage applied thereto to provide beam focusing.

In one embodiment and as understood in the art, beam of electrons 67 of FIG. 2 may be magnetically deflected to control and provide deflection in a beam length direction 66, a beam or emitter width direction 68, or both. In such an embodiment, an aperture (not shown) is positioned between cathode 60 and target 57, and more particularly between one-dimensional grid 70 and target 57, to allow passage of electrons 67 with minimal or no interference from the controlling magnetic field.

Figure 3:
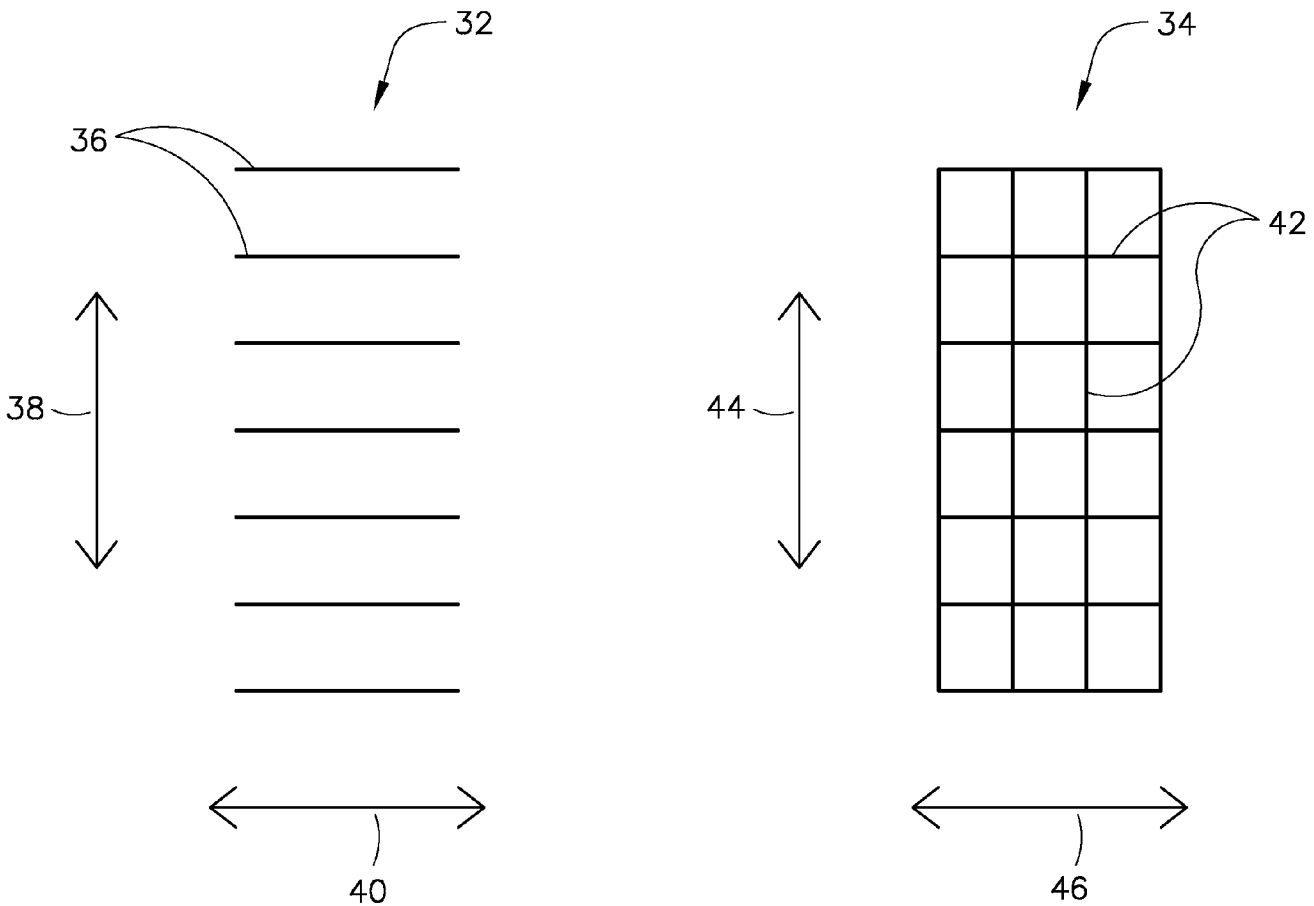
FIG. 3 illustrates a one-dimensional grid and a two-dimensional grid.

FIG. 3 illustrates a one-dimensional grid 32 and a two-dimensional grid 34 to define such terminology with respect to embodiments of the invention. One-dimensional grid 32 includes a plurality of rungs 36 that are positioned along one-dimensional direction 38, each rung 36 extending and having substantial length in a second direction 40. As such, for the purpose of illustrating embodiments of the invention, one-dimensional grid 32 is defined as having a parallel uni-or one-dimensional arrangement, the length of each rung extending in a second, or length direction 40. In contrast, FIG. 3 also illustrates two-dimensional grid 34 having rungs 42 that are positioned along a first direction 44 and along a second direction 46.

In the embodiments illustrated in FIGS. 4-12, one-dimensional grid 70 is positioned proximately to filament or emitter 55 and between emitter 55 and target 57. In a preferred embodiment, one-dimensional grid 70 is positioned from 0.05 mm to 1 mm from emitter 55, depending on needs of the x-ray tube, image quality, characteristics of the emitter, desired operating temperature of one-dimensional grid 70, and the like. In embodiments of the invention, one-dimensional grid 70 includes an electrically conductive material such as tungsten, molybdenum, and the like. Further, because one-dimensional grid 70 is electrically biased with a voltage that may differ from the cup to which it is attached, one-dimensional grid 70 is typically attached thereto via attachments that are insulated from the cup, as is understood in the art. Additionally, the bias voltage applied to one-dimensional grid 70 may be selected based on a desired mA and kV. As an example, for 80 kV, a resulting beam current of 1000 mA may result with a slightly positive bias voltage applied to one-dimensional grid 70. And, for 140 kV, a resulting beam current of 700 mA may result with a slightly negative bias voltage applied to one-dimensional grid 70. Thus, as kV is switched during, for instance, a dual energy acquisition, bias voltage to the one-dimensional grid 70 may likewise and correspondingly be adjusted as well.

In the embodiments illustrated in FIGS. 4-12, cathode 60 is illustrated having emitter 55 and grid 70 positioned therewith, and grid 70 includes crosspieces or rungs 72. Rungs 72 are positioned in a parallel uni-or one-dimensional arrangement as discussed above in FIG. 3, the length of each rung spanning generally in a width direction (illustrated in FIG. 2 as element 68) of emitter 55. According to the embodiments illustrated, rungs 72 are configured to expand and contract during operation of cathode 60 without significant impact on image quality. Such is accomplished by configuring rungs 72 to expand and contract relative to the cathode cup 73 on which they are mounted, or relative to their attachment points to the cathode cup 73, or relative to each other, without substantial distortion or out-of-plane motion with respect to emitter 55 or cup 73. Thus, rungs 72 are typically configured in a planar arrangement (in the cases of generally flat rungs) or in a cylindrical arrangement (in the case of a coiled arrangement, as will be discussed with respect to FIG. 7). Further, in the embodiments of FIGS. 4-6 and 8-12, although for purposes of illustration rungs 72 and other support members and beams of rungs 72 are illustrated as having minimal thickness/depth, one skilled in the art will recognize that rungs 72 and all other members therein may have significant and visually evident thickness (or depth), which may be selected based on desired mechanical, thermal, emissive, and other properties as is understood in the art.

According to embodiments of the invention, rungs 72 may preferably include a width of approximately 0.5 mm and a depth of approximately 0.3-0.4 mm. Rung width as discussed herein is not to be confused with emitter width of emitter 55. Emitter width is designated as passing in a direction 68 in FIG. 2 and generally passing into and out of the page of FIG. 2. Rung width on the other hand, as illustrated in FIG. 4, corresponds to a width of each rung that is designated as a direction 88, which corresponds to a focal spot length direction, which corresponds to direction 66 of FIG. 2.

Emitter 55 may be configured to have a pattern (not shown) on the surface thereof that reduces emissions therefrom by mechanically or chemically affecting the work function thereof as is commonly understood in the art. In such fashion, emission from emitter 55 to rungs 72 may be reduced, thus reducing the overall propensity for rungs 72 to absorb electrons and heat during operation of emitter 55.

Figure 4:
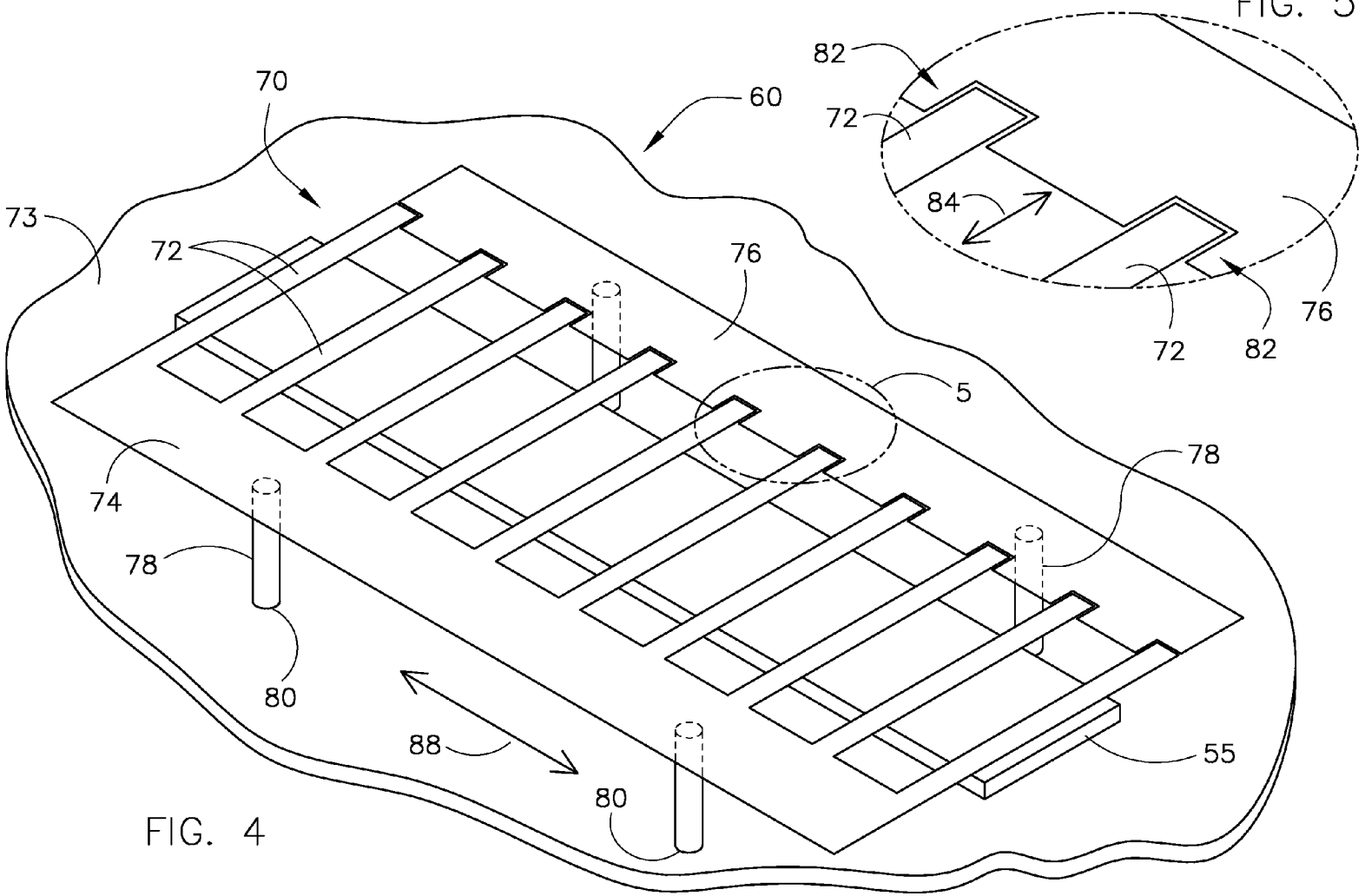

FIGS. 4 and 5 illustrate cathode 60 having emitter 55 and one-dimensional grid 70 according to an embodiment of the invention. In this embodiment, one-dimensional grid 70 includes a first support beam or mounting beam 74 and a second support beam or mounting beam 76. As illustrated, rungs 72 are fixedly attached to first beam 74 and slideably attached to second beam 76. In this embodiment, each beam 74, 76 is fixedly attached to cathode cup 73 via attachments or legs 78 at attachment points 80. Second beam 76, as illustrated, includes slots 82 into which rungs 72 are slideably captured or attached. Rungs 72 are slip-fitted into slots 82 with, for example, a line-line fit up to a 1 to 5 micron clearance. Thus, during operation, as rungs 72 heat and cool due to electron deposition therein, rungs 72 slide back and forth 84 in slots 82, thus avoiding substantial distortion or out-of-plane motion in rungs 72 with respect to beams 74, 76 and mount points 80.

Figure 6:
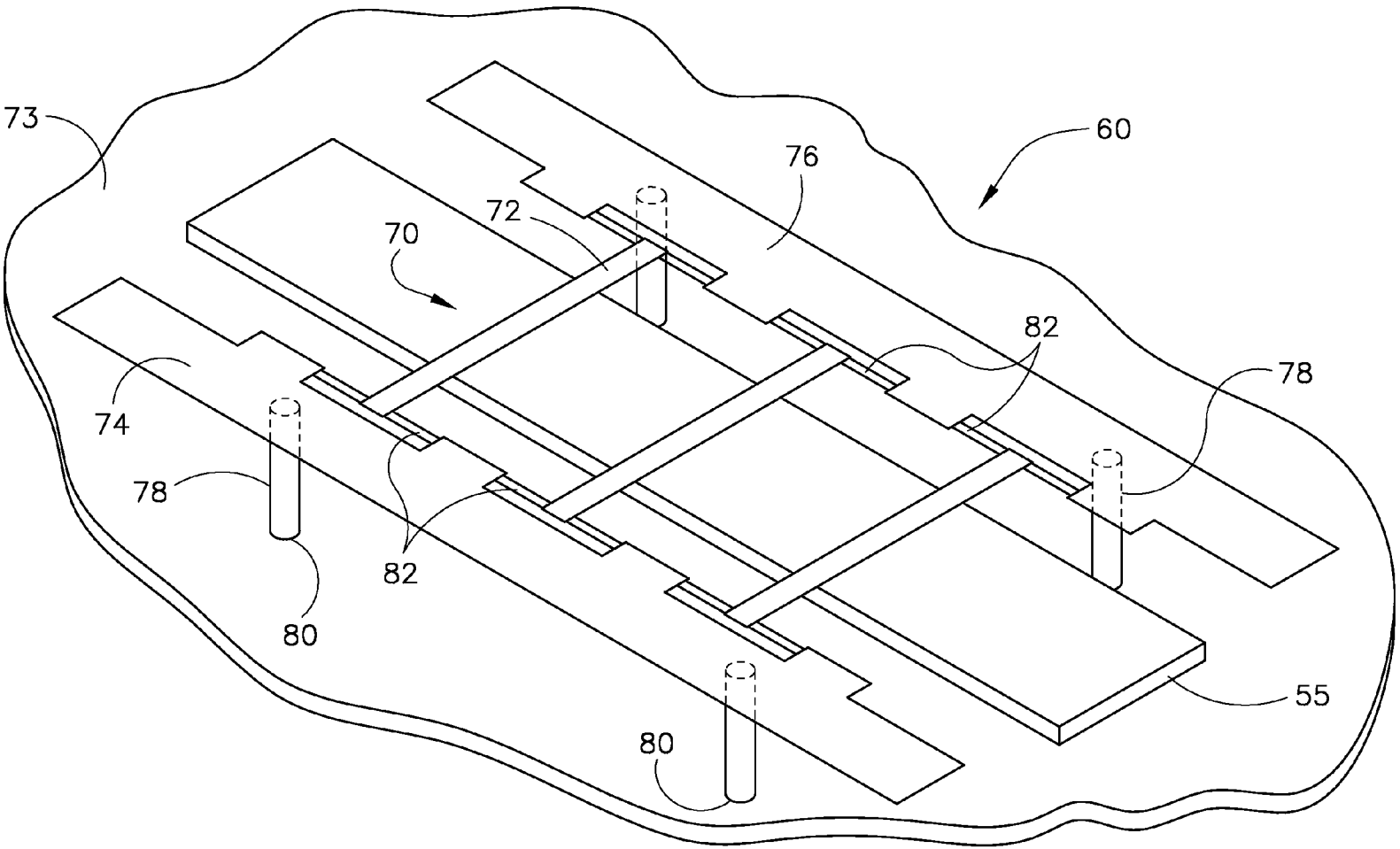
FIG. 6 illustrates a cathode having rungs of a one-dimensional mesh flexibly attached thereto according to an embodiment of the invention.

FIG. 6 illustrates cathode 60 having emitter 55 and one-dimensional grid 70 according to another embodiment of the invention. In this embodiment, one-dimensional grid 70 includes first and second support or mount beams 74, 76 that are fixedly attached to cathode cup 73 via attachments 78 at attachment points 80. Rungs 72 are flexibly attached to beams 74, 76 via a pair of respective flexible links 83. Thus, during operation as rungs 72 heat and cool due to electron deposition therein, flexible links 83 compliantly respond to growth and contraction of rungs 72, thus avoiding substantial distortion or out-of-plane motion in rungs 72.

Figure 7:
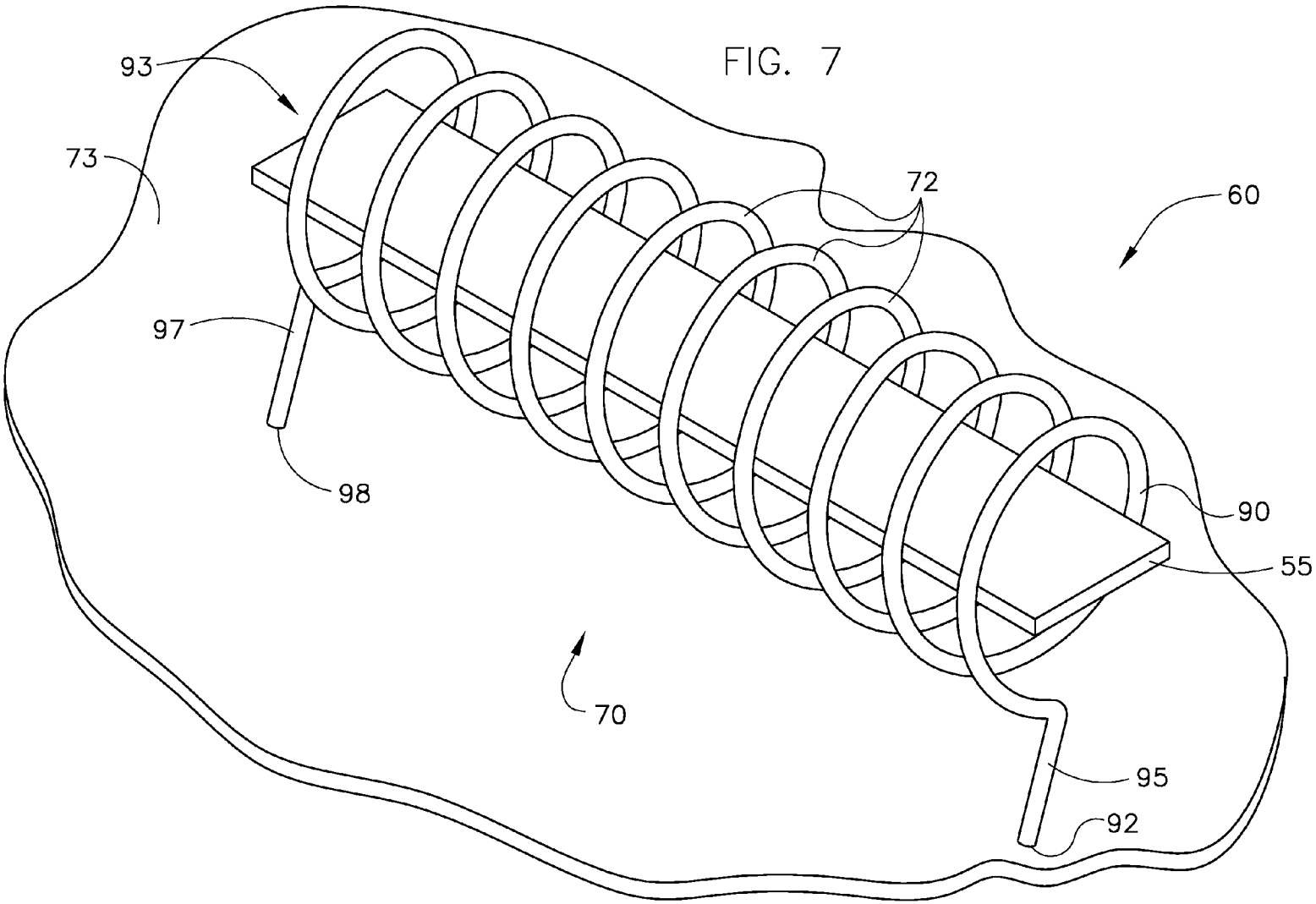
FIG. 7 illustrates a cathode having coiled rungs of a one-dimensional mesh according to an embodiment of the invention.

FIG. 7 illustrates cathode 60 having emitter 55 and one-dimensional grid 70 according to another embodiment of the invention. In this embodiment, one-dimensional grid 70 includes a flexible, wound coil 90 having a center 93 in which emitter 55 is positioned. Each turn or ring of coil 90 represents a respective rung 72 of grid 70 that encircles emitter 55. A pair of legs 95, 97 of coil 90 attach coil 90 to cathode cup 73 at respective attachment points 92, 98. In one embodiment legs 95 and 97 are electrically isolated from the cathode cup 73. During operation, as rungs 72 of coil 90 heat and cool, coil 90 is caused to expand and contract, and because of the flexibility of coil 90, substantial distortion or out-of-plane motion in rungs 72 is avoided.

Figure 8:
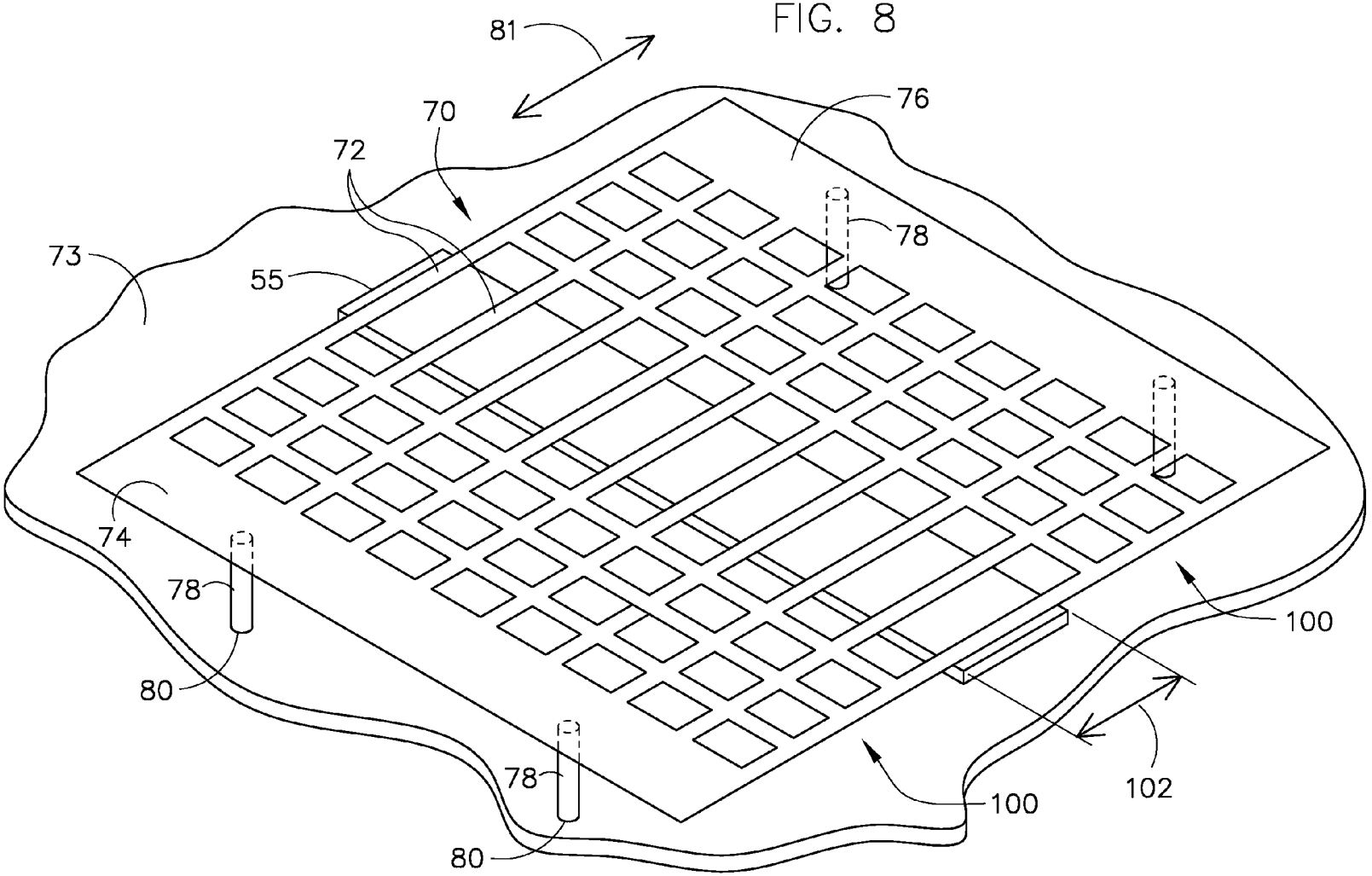
FIG. 8 illustrates a cathode having a one-dimensional mesh attached to two-dimensional meshes according to an embodiment of the invention.

FIG. 8 illustrates cathode 60 having emitter 55 and one-dimensional grid 70 according to another embodiment of the invention. In this embodiment, one-dimensional grid 70 includes rungs 72 that extend between a pair of two-dimensional grids 100 that are positioned beyond a width 102 of emitter 55. Two-dimensional grids 100 are fixedly attached to first and second beams 74, 76. First and second beams 74, 76 are flexibly attached to cathode cup 73 at attachment points 80 via legs or attachments 78. During operation, as one-dimensional grid 70 and two-dimensional grids 100 expand and contract, first and second beams 74, 76 correspondingly move back and forth 81, accordingly, relative to attachment points 80. Because beams 74, 76 are flexibly attached to attachment points 80, attachments 78 correspondingly flex to accommodate the growth and contraction of grids 70 and 100, thus substantial distortion or out-of-plane motion in rungs 72 is avoided. The function of the 2-D dimensional segments 100 is to reduce the length of the rungs 72 thereby offering additional stiffness against distortion and out-of-plane displacement without substantially disrupting the accelerating electric field.

Figure 9:
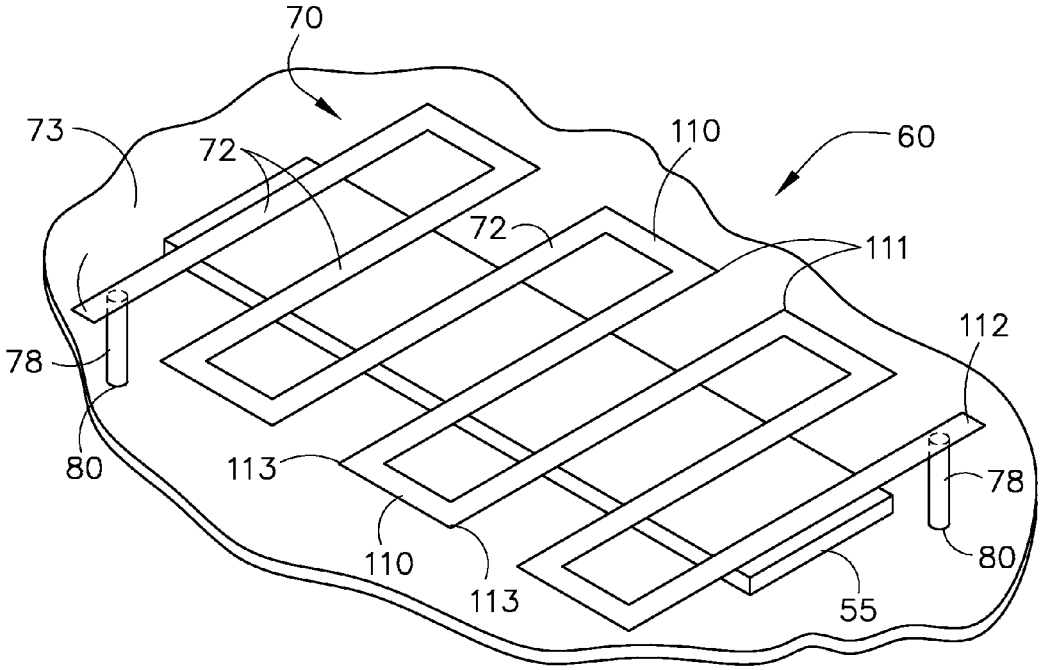
FIG. 9 illustrates a one-dimensional mesh having a zig-zag pattern of rungs according to an embodiment of the invention.

FIG. 9 illustrates cathode 60 having emitter 55 and one-dimensional grid 70 of wire according to another embodiment of the invention. In this embodiment, one-dimensional grid 70 includes rungs 72 that each are attached one to another via connectors 110 at alternating ends 111, 113 of rungs 72. A "zig-zag" pattern of rungs 72 is thus formed, and ends 112 of grid 70 are attached to attachment points 80 of cathode cup 73 via attachments 78. In operation, as rungs 72 expand and contract from heating and cooling and as connectors 110 expand and contract (which may be due to conduction from rungs 72 or from stray electrons passing thereto), attachments 78 likewise flex along with the expansion and contraction of grid 70, thus substantial distortion or out-of-plane motion in rungs 72 is avoided. In this embodiment, one-dimensional grid 70 may be fabricated from a single wire formed into the zig-zag pattern, from multiple wire extensions welded or otherwise attached to form the zig-zag pattern, or from a plane of material with the pattern of grid 70 etched or cut therefrom.

Figure 10:
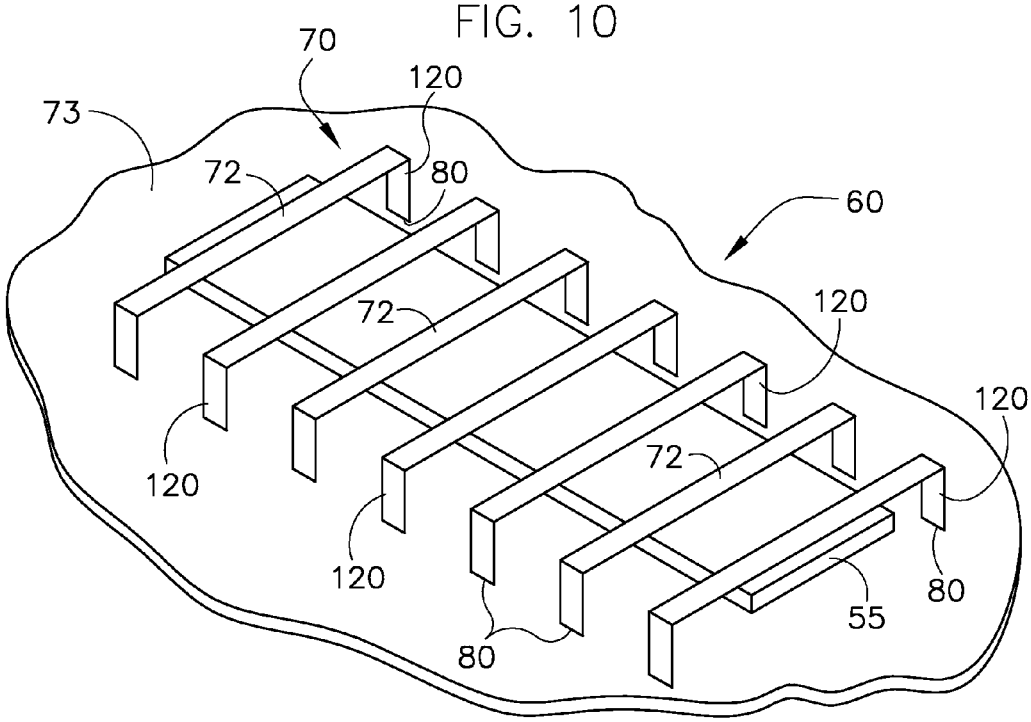
FIG. 10 illustrates a one-dimensional mesh comprised of a plurality of U-shaped rungs according to an embodiment of the invention.

FIG. 10 illustrates cathode 60 having one-dimensional grid 70 of wires or rungs 72 and emitter 55. In this embodiment, each rung 72 is "staple-" or U-shaped with legs 120 having a length and material selected such that leg 120 deflects in response to the thermal expansion of the rung without distortion of rungs 72. In one embodiment (not shown), legs 120 are longer than rungs 72 such that legs 120 flex, thus allowing rungs 72 to expand and contract during thermal expansion and contraction. In operation, as rungs 72 expand and contract from heating and cooling, legs 120 flex accordingly, allowing growth and contraction of grid 70 without substantial distortion or out-of-plane motion of rungs 72.

Figure 11:
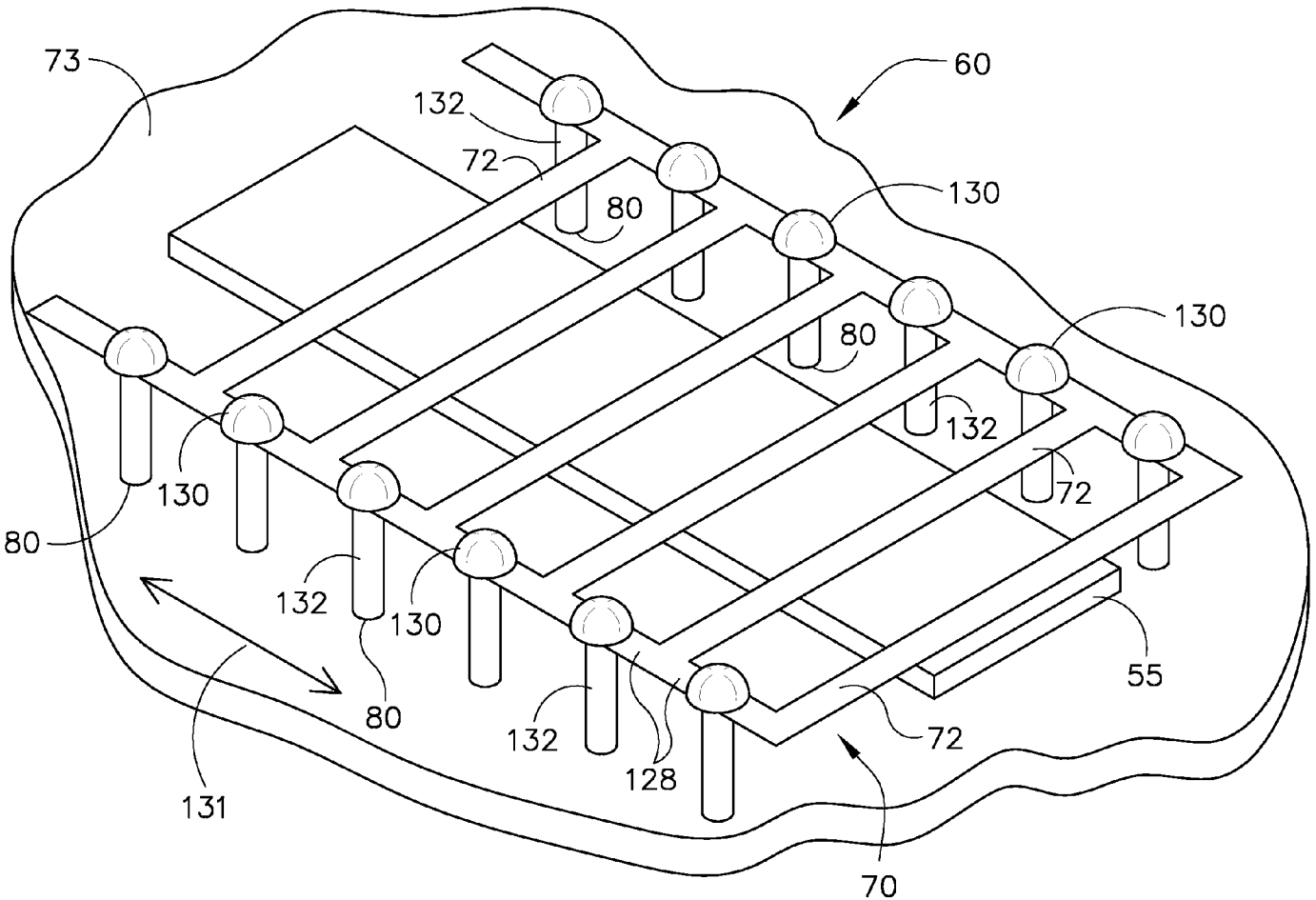
FIG. 11 illustrates a one-dimensional mesh of rungs attached one to another at axial attachment according to an embodiment of the invention.

FIG. 11 illustrates cathode 60 having one-dimensional grid 70 and emitter 55. In this embodiment, each rung 72 is attached to another rung 72 via a plurality of connectors 128 positioned therebetween and extending along a direction 131 of the length of emitter 55. Each connector 128 is mechanically attached to another connector 128 via a mechanical attachment, such as a weld, at attachment points 130. Grid 70 is thereby attached to cathode cup 73 via a plurality of flexible extension members or connectors 132 attached at attachment points 80. And, although FIG. 11 illustrates a connector 132 at each attachment point 130, one skilled in the art will recognize that not all attachment points 130 need to include a connector 132 attached to cathode cup 73. In operation, as rungs 72 expand and contract from heating and cooling, connectors 132 likewise flex, allowing growth and contraction of grid 70 without substantial distortion or out-of-plane motion of rungs 72.

Figure 12:
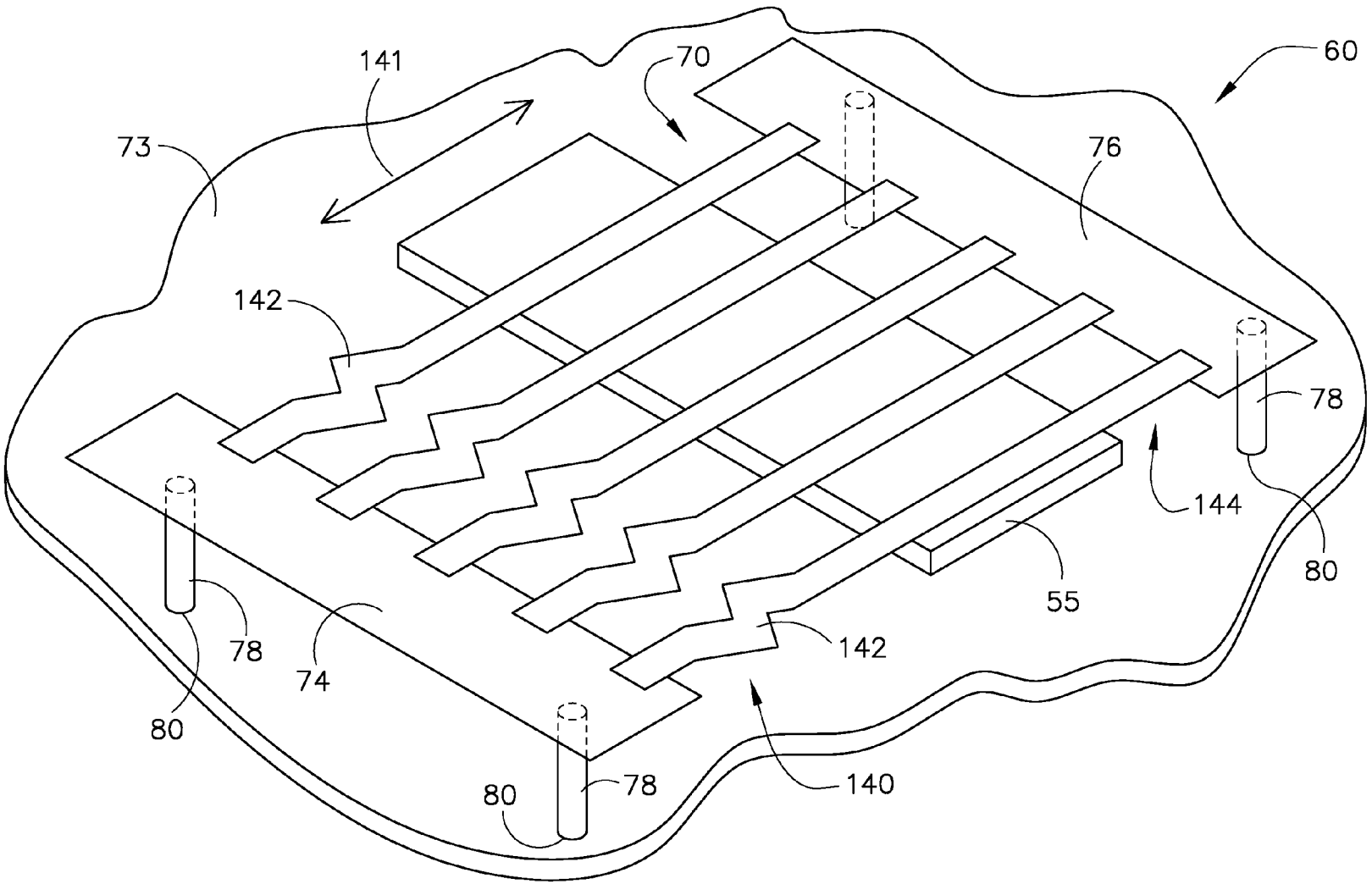
FIG. 12 includes a one-dimensional mesh of rungs springably attached to support beams according to an embodiment of the invention.

FIG. 12 illustrates cathode 60 having one-dimensional grid 70 and emitter 55. One-dimensional grid 70 includes first and second mounting beams 74, 76 that are attached to cathode cup 73 via legs or attachments 78 and to attachment points 80. Attachments 78 are fixedly attached to attachment points 80 in one embodiment and flexibly attached to attachment points 80 in another embodiment. When flexibly attached, attachments 78 include wires or other flexible attachments that are substantially compliant and bend or flex when rungs 72 expand or contract in direction 141.

In this embodiment each rung 72 is springably attached at a first end 140 thereof to first mounting beam 74 via a respective spring 142, and each rung 72 is fixedly attached at a second end 144 thereof to second mounting beam 76. Thus, in operation, as rungs 72 expand and contract from heating and cooling in direction 141, springs 142 likewise take up some or all of the expansion and contraction thereof, allowing growth and contraction of grid 70 without substantial distortion or out-of-plane motion of rungs 72.

Figure 13:
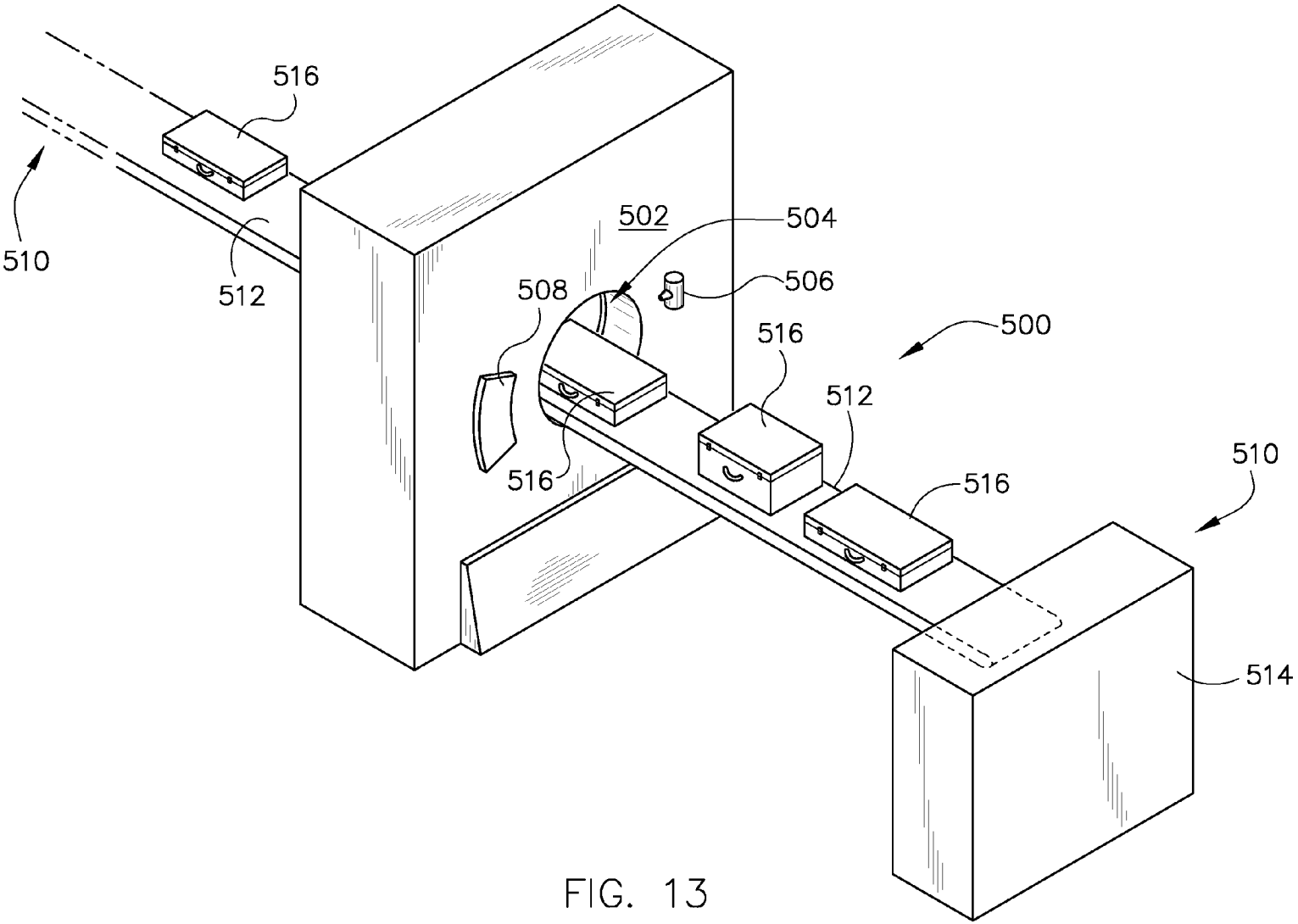
FIG. 13 is a pictorial view of an x-ray system for use with a non-invasive package inspection system that can benefit from incorporation of an embodiment of the invention.

FIG. 13 is a pictorial view of an x-ray system 500 for use with a non-invasive package inspection system. The x-ray system 500 includes a gantry 502 having an opening 504 therein through which packages or pieces of baggage may pass. The gantry 502 houses a high frequency electromagnetic energy source, such as an x-ray tube 506, and a detector assembly 508. A conveyor system 510 is also provided and includes a conveyor belt 512 supported by structure 514 to automatically and continuously pass packages or baggage pieces 516 through opening 504 to be scanned. Objects 516 are fed through opening 504 by conveyor belt 512, imaging data is then acquired, and the conveyor belt 512 removes the packages 516 from opening 504 in a controlled and continuous manner. As a result, postal inspectors, baggage handlers, and other security personnel may non-invasively inspect the contents of packages 516 for explosives, knives, guns, contraband, etc. One skilled in the art will recognize that gantry 502 may be stationary or rotatable. In the case of a rotatable gantry 502, system 500 may be configured to operate as a CT system for baggage scanning or other industrial or medical applications.

A technical contribution for the disclosed method and apparatus is that is provides for a computer implemented method and apparatus of that relate generally to x-ray imaging devices and, more particularly, to an x-ray tube having an improved cathode structure and improved control of electron beam emission.

According to one embodiment of the invention, an x-ray imaging system includes a detector positioned to receive x-rays, and an x-ray tube coupled to a mount structure. The x-ray tube is configured to generate x-rays toward the detector and includes a target, a cathode cup, an emitter attached to the cathode cup and configured to emit a beam of electrons toward the target, the emitter having a length and a width, and a one-dimensional grid positioned between the emitter and the target and attached to the cathode cup at one or more attachment points. The one-dimensional grid includes a plurality of rungs that each extend in a direction of the width of the emitter, and the plurality of rungs are configured to expand and contract relative to the one or more attachment points without substantial distortion with respect to the emitter.

In accordance with another embodiment of the invention, a method of fabricating a cathode assembly includes attaching a filament to a cathode cup, forming a one-dimensional grid having crosspieces that extend generally along a width direction of the filament, positioning the grid proximately to the filament such that electrons that emit from the filament pass between the crosspieces of the one-dimensional grid when accelerated toward an anode, and attaching the grid to the cathode cup at attachment points such that the crosspieces expand, when heated, relative to the attachment points without distorting with respect to neighboring crosspieces.

In accordance with yet another embodiment of the invention, an x-ray tube includes a target configured to emit electrons from a focal spot, a cup, an emitter attached to the cup and positioned to emit high-energy electrons toward the focal spot, and a uni-dimensional grated mesh positioned proximately to the emitter and between the target and the emitter such that emitted electrons pass between rungs of the mesh. The uni-dimensional grated mesh is attached to the cup at attachment points such that rungs of the mesh expand and contract, upon heating and cooling, without substantial distortion with respect to the cup.

Embodiments of the invention have been described in terms of the preferred embodiment(s), and it is recognized that equivalents, alternatives, and modifications, aside from those expressly stated, are possible and within the scope of the appending claims.

What is claimed is:

1. An x-ray imaging system comprising:

a detector positioned to receive x-rays;

an x-ray tube coupled to a mount structure and configured to generate x-rays toward the detector, the x-ray tube comprising:

a target;

a cathode cup;

an emitter attached to the cathode cup and configured to emit a beam of electrons toward the target, the emitter having a length and a width; and a one-dimensional grid positioned between the emitter and the target and attached to the cathode cup at one or more attachment points, the one-dimensional grid comprising:

a plurality of rungs that each extend in a direction of the width of the emitter;

a pair of mounting beams, wherein each of the plurality of rungs comprises at least one end flexibly, slidably or springably attached to a respective one of the mounting beams such that the plurality of rungs are configured to expand and contract relative to the one or more attachment points without substantial distortion with respect to the emitter.

2. The x-ray imaging system of claim 1 wherein each of the plurality of rungs comprises a first end fixedly attached to a first mounting beam and a second end springably attached to a second mounting beam.

3. The x-ray imaging system of claim 1, further comprising:

connectors coupled between neighboring pair of rungs; and at least two extension members coupled to the plurality of rungs and configured to attach the plurality of rungs to the cathode cup at respective attachment points, wherein the attachment points are positioned on alternating ends of the rungs, such that the plurality of rungs and their respective connectors form a zig-zag pattern.

4. The x-ray imaging system of claim 1 wherein the one-dimensional grid further comprises a plurality of rings forming a coil, each ring forming a rung of the plurality of rungs and configured to encircle the emitter, the coil comprising a pair of legs coupled to the plurality of rings, each leg attached to a respective attachment point.

5. The imaging system of claim 1 wherein the one-dimensional grid further comprises a first mounting beam and a second mounting beam; and wherein a first end of each of the plurality of rungs is flexibly attached to one of the first and second mounting beams and a second end of each of the plurality of rungs is fixedly attached to the other of the first and second mounting beams to allow flexure of the mounting beams along a width direction of the emitter.

6. A method of fabricating a cathode assembly, the method comprising:

attaching a filament to a cathode cup;

forming a one-dimensional grid having crosspieces that extend generally along a width direction of the filament, wherein forming the one-dimensional grid comprises one of:

forming a wire into a zig-zag pattern to form each of the crosspieces, wherein the wire comprises two ends, each end of the wire attached to a respective attachment point; or forming a plurality of coil rings, each coil ring of the plurality of coil rings forming a respective crosspiece of the plurality of crosspieces; or providing a first support beam and a second support beam, fixedly attaching first ends of the crosspieces to the first support beam, and slideably capturing second ends of the crosspieces in slots in the second beam;

positioning the grid proximately to the filament such that electrons that emit from the filament pass between the crosspieces of the one-dimensional grid when accelerated toward an anode; and attaching the grid to the cathode cup at attachment points such that the crosspieces expand, when heated, relative to the attachment points without distorting with respect to neighboring crosspieces.

7. A method of fabricating a cathode assembly, the method comprising:

attaching a filament to a cathode cup;

forming a one-dimensional grid having crosspieces that extend generally along a width direction of the filament, wherein forming the one-dimensional grid comprises:

providing a first support beam and a second support beam; and one of fixedly attaching first ends of the crosspieces to the first support beam and springably attaching second ends of the crosspieces to the second beam; or flexibly attaching first ends of the crosspieces to the first support beam and fixedly attaching second ends of the crosspieces to the second beam;

positioning the grid proximately to the filament such that electrons that emit from the filament pass between the crosspieces of the one-dimensional grid when accelerated toward an anode; and attaching the grid to the cathode cup at attachment points such that the crosspieces expand, when heated, relative to the attachment points without distorting with respect to neighboring crosspieces.

8. An x-ray tube comprising:

a target configured to emit electrons from a focal spot;

a cup;

an emitter attached to the cup and positioned to emit high-energy electrons toward the focal spot; and a uni-dimensional grated mesh positioned proximately to the emitter and between the target and the emitter such that emitted electrons pass between rungs of the mesh, wherein the uni-dimensional grated mesh comprises a coil and wherein the emitter is positioned within the coil;

wherein the uni-dimensional grated mesh is fixedly attached to the cup at attachment points such that rungs of the mesh expand and contract, upon heating and cooling, without substantial distortion with respect to the cup.

9. An x-ray tube comprising:

a target configured to emit electrons from a focal spot;

a cup;

an emitter attached to the cup and positioned to emit high-energy electrons toward the focal spot; and a uni-dimensional grated mesh positioned proximately to the emitter and between the target and the emitter such that emitted electrons pass between rungs of the mesh, the uni-dimensional grated mesh being fixedly attached to the cup at attachment points such that rungs of the mesh expand and contract, upon heating and cooling, without substantial distortion with respect to the cup; and a pair of mounting beams, wherein each of the rungs comprises at least one end flexibly, slidably or springably attached to a respective one of the mounting beams such that the rungs are allowed to expand and contract relative to the one or more attachment points without substantial distortion with respect to the emitter.

* * * * *